US005355821A

United States Patent [19]

Johnson

[11] Patent Number: 5,355,821

[45] Date of Patent: Oct. 18, 1994

[54] STEERING APPARATUS FOR AN OUTBOARD MOTOR

[75] Inventor: Bruce D. Johnson, Bloomington, Minn.

[73] Assignee: Red Line Industries, Inc., Minneapolis, Minn.

[21] Appl. No.: 220,607

[22] Filed: Mar. 31, 1994

[51] Int. Cl.[5] ..... B63H 25/00

[52] U.S. Cl. ..... 114/144 R; 440/60

[58] Field of Search ..... 114/144 R, 159, 154; 440/58-60, 6, 7, 900; 254/95, 97; 74/480 B, 89.17

[56] References Cited

U.S. PATENT DOCUMENTS

| | | | |
|---|---|---|---|
| 2,700,358 | 1/1955 | Johnson | 440/60 |
| 2,804,838 | 9/1957 | Moser | 440/58 |
| 2,928,631 | 3/1960 | Hartman | 440/59 |
| 3,121,415 | 2/1964 | Anderson et al. | 440/59 |
| 4,715,836 | 12/1987 | Schulte | 440/6 |
| 4,915,050 | 4/1990 | Wicker et al. | 440/53 |
| 4,950,187 | 8/1990 | Smith | 440/7 |
| 5,029,547 | 7/1991 | Novey | 114/159 |
| 5,127,856 | 7/1992 | Kabuto et al. | 114/144 R |
| 5,244,426 | 9/1993 | Miyashita et al. | 114/144 R |

*Primary Examiner*—Edwin L. Swinehart
*Attorney, Agent, or Firm*—Burd, Bartz & Gutenkauf

[57] ABSTRACT

An electro mechanical steering mechanism used to remotely steer an outboard motor. A battery powered gear head motor drives a gear rack running horizontally through a generally square tube mounted on the inside of a boat transom. Spring connectors attached to opposite ends of the gear rack are connected to the outboard motor whereby when the steering mechanism is activated to laterally move the gear rack causing the spring connectors to move the outboard motor to selected positions thereby controlling the turning of the outboard motor.

23 Claims, 4 Drawing Sheets

STEERING APPARATUS FOR AN OUTBOARD MOTOR

FIELD OF THE INVENTION

The invention relates to marine motor steering mechanisms, particularly remote controlled electric powered steering units for outboard motors.

BACKGROUND OF THE INVENTION

Outboard motors that are clamped to the transom at the stern of the boat require the operator of the motor to remain in the rear seat and use one hand to control the tiller handle of the motor thereby making it difficult to effectively handle fishing lines during the trolling operation. Also, the motor operator's fishing line has to be generally placed adjacent the wake of the motor decreasing the occurrence of catching easily spooked fish, such as walleyes or salmon.

Remote steering units for boat motors have been made utilizing hydraulics and screw drives. These units encountered problems of complexity, compactness of organization, and effectiveness in use.

SUMMARY OF THE INVENTION

The invention is directed to an electro mechanical steering mechanism for an outboard motor. The steering mechanism remotely controls the direction of movement of a boat while permitting the operator to be positioned in an improved fishing location or any convenient location in the boat, such as in the middle of the boat or near the front thereof. The steering mechanism is easily mounted on the transom of the boat and attachable to existing boat motors to convert a manual steering motor into a power steered motor with remote steering capability in a minimum of time and with a few simple tools.

The steering apparatus has a mounting bracket having a first end and a second end. The first end of the bracket is mounted to the stern of the boat with the clamping structure used to mount the outboard motor to the boat. The second end includes a generally tubular member extending linearly generally parallel to the stern of the boat that accommodates an elongated generally rectangular member slidably located within the tubular member. The tubular member includes a top wall having a pair of transverse slots open to opposite ends thereof. The slots control the lateral movement of the rectangular member within the tubular member. A pair of spring connectors secured to the opposite ends of the rectangular member are attachable to the outboard motor and operable to pull the motor from side to side when the rectangular member is linearly moved relative to the tubular member to control the direction of movement of the boat.

An electric motor secured to the mounting bracket is operable to reversibly move the rectangular member in opposite lateral directions. The rectangular member has a side wall having a plurality of teeth located in engagement with the drive gear of the electric motor. The tubular member has a side wall having a centrally located opening therein to allow the drive gear to mesh with the teeth of the rectangular member. A remote control device is operably connected to a source of power and to the electric motor to control the operation of the electric motor to linearly move the rectangular member thereby steering the boat from a location remote from a rear area of the boat. A guard secured to the rectangular member covers the top of the rectangular member and the drive gear of the motor means to prevent injury to persons in the boat.

DESCRIPTION OF THE PREFERRED EMBODIMENT

Figure 1:
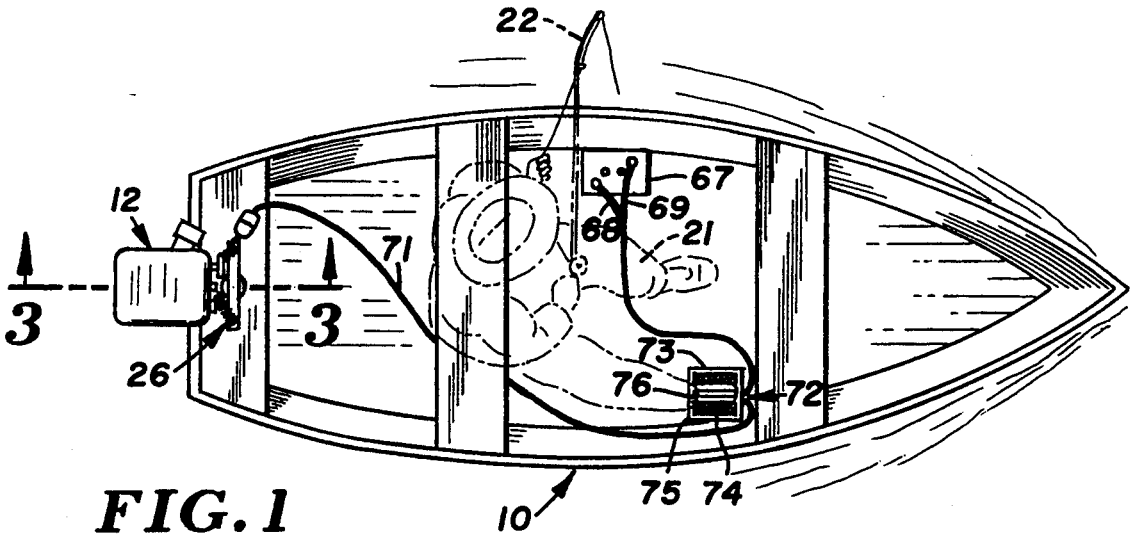
FIG. 1 is a plan view of a fishing boat with an outboard motor mounted on the stern thereof equipped with the steering apparatus of the invention.
Figure 2:
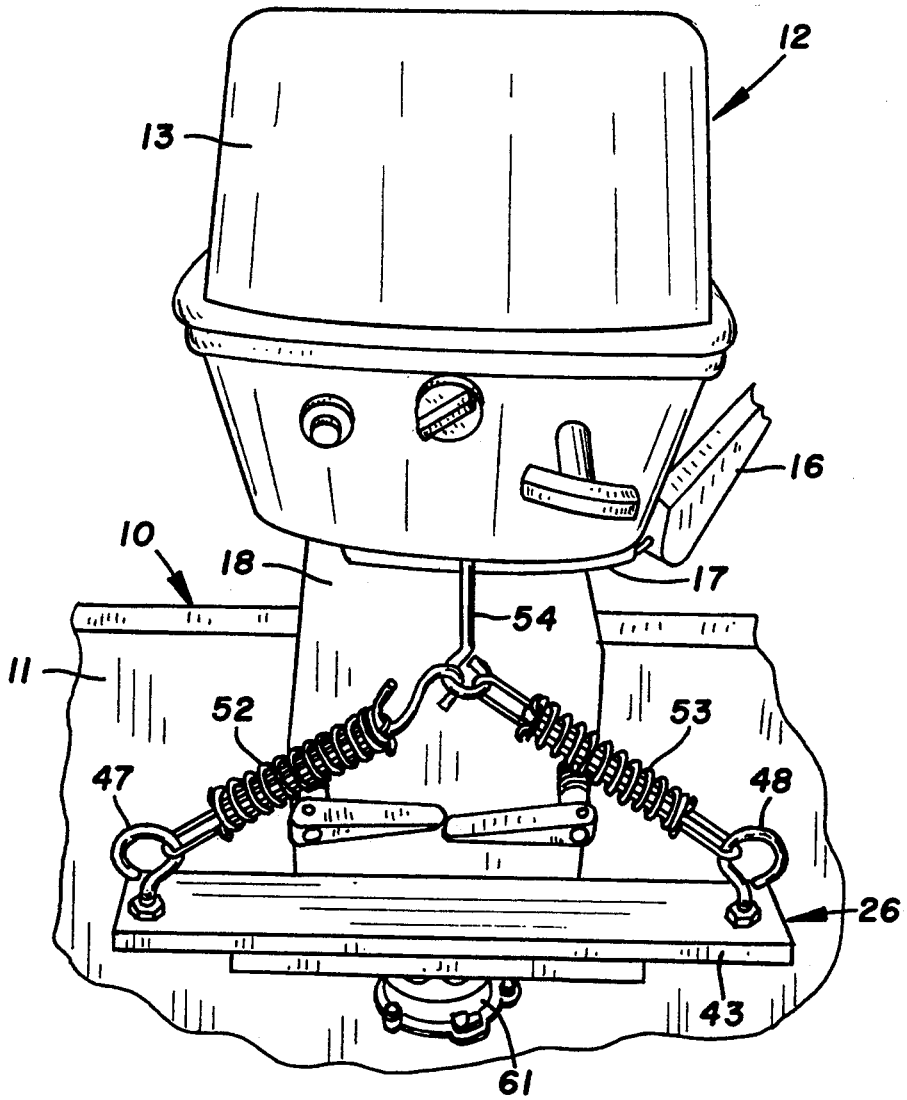
FIG. 2 is a front elevational view of the outboard motor and steering apparatus therefor.

Referring to FIGS. 1 and 2, there is shown an outboard motor 12 mounted on a fishing boat 10. Outboard motor 12 has a power head 13, a drive tube 14 and a propeller assembly (not shown). Outboard motor 12 includes a handle 16 operable to control the supply of fuel to outboard motor 12 as well as to manually rotate drive tube 14 and control the direction of movement of boat 10. Motor 12 has a boat mounting frame 18 having a clamp member 19 to clamp to transom 11 of boat 10. Power head 13 and drive tube 14 with the prop assembly pivot together on a substantially vertical axis by means of a bracket 17 that swings on a transverse horizontal axis secured to transom 11 of boat 10 by mounting frame 18.

Referring to FIGS. 2 to 7, there is shown a steering mechanism of the invention, indicated generally at 26, for providing electric powered steering control for an outboard motor 12 mounted on a fishing boat 10. Steering mechanism 26 is a separate unit mounted on transom 11 of boat 10 and operably attached to outboard motor 12 for electric remote steering of boat 10.

Steering mechanism 26 is not permanently secured to boat 10 allowing steering mechanism 26 to be moved from one craft to another very easily at any time. Steering mechanism 26 can be connected to existing motors without modification and used to remotely steer an electric trolling motor or other auxiliary motors on other types of watercraft, such as sail boats.

Figure 3:
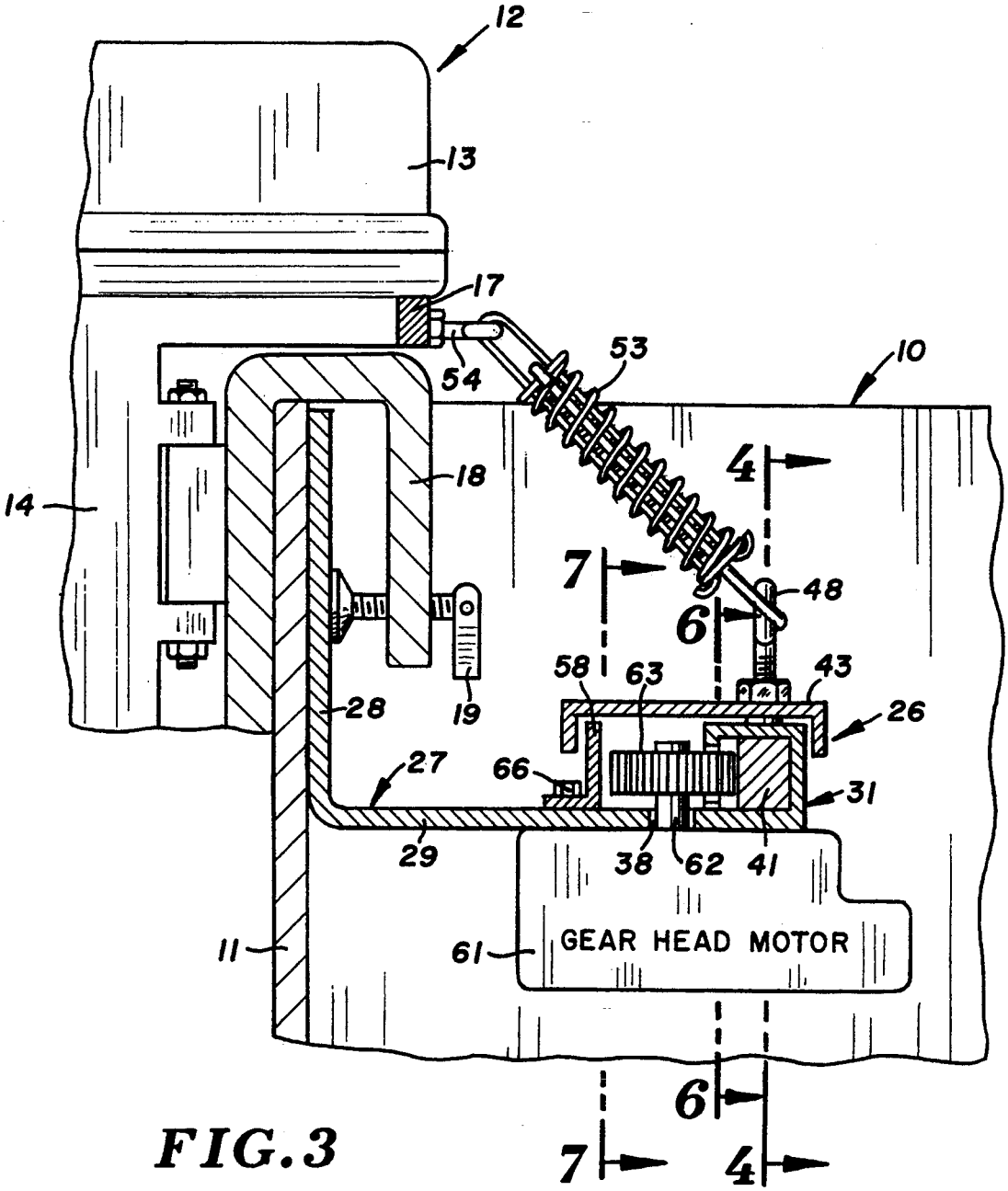
FIG. 3 is an enlarged sectional view taken along the line 3—3 of FIG. 1.

The structure of steering mechanism 26 is generally compact in nature extending generally parallel to transom 11 as seen in FIGS. 2 and 3. Steering device 26 enables steering of outboard motor 12 at any desired location forwardly in boat 10, preferably by the foot of fisherperson 21. A three-button foot pedal control assembly 72 is used to operate steering mechanism 26 to turn outboard motor 12 from side to side or kill or stop outboard motor 12. Fisherperson 21, shown in broken lines in FIG. 1, can steer outboard motor 12 with a foot touch of control assembly 72 leaving both hands free to operate rod and reel 22, a fish locator, handle bait and the like.

Steering mechanism 26 has an angle mounting bracket 27 adapted to be placed adjacent transom 11 and boat mounting frame 18 for clamping to transom 11.

Angle mounting bracket 27 has a generally vertical or upright end 28 joined to a generally horizontal or transverse base plate 29. Angle bracket 27 is clamped to transom 11 of boat 10 with the clamp structure of outboard motor 12. As shown in FIG. 3, clamp screws 19 of outboard motor 12 are used to secure bracket 27 of steering mechanism 26 in place. Vertical or upright end 28 of angle bracket 27 is clamped between transom 11 of boat 10 and frame 18 of outboard motor 12 where base plate 29 extends horizontally forwardly and below frame 18. Clamp screws 19 also secure frame 18 in place when outboard motor 12 is clamped to transom 11. Thus, steering mechanism 26 can be used on any type of marine craft to which an outboard motor can be mounted. No separate fasteners, holes or other permanent modification of the marine craft are required in order to use steering mechanism 26. Angle mounting bracket 27 is preferably an extruded aluminum member. Other materials can be used to make angle bracket 27.

Figure 5:
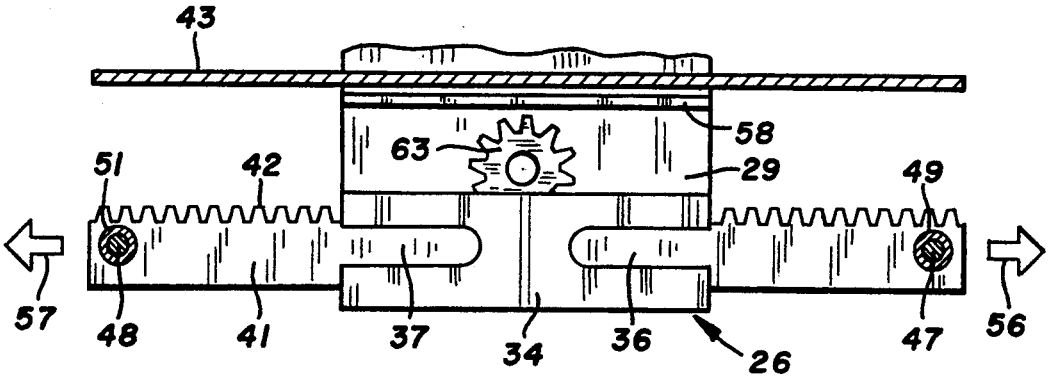
FIG. 5 is a sectional view taken along the line 5—5 of FIG. 4.
Figure 6:
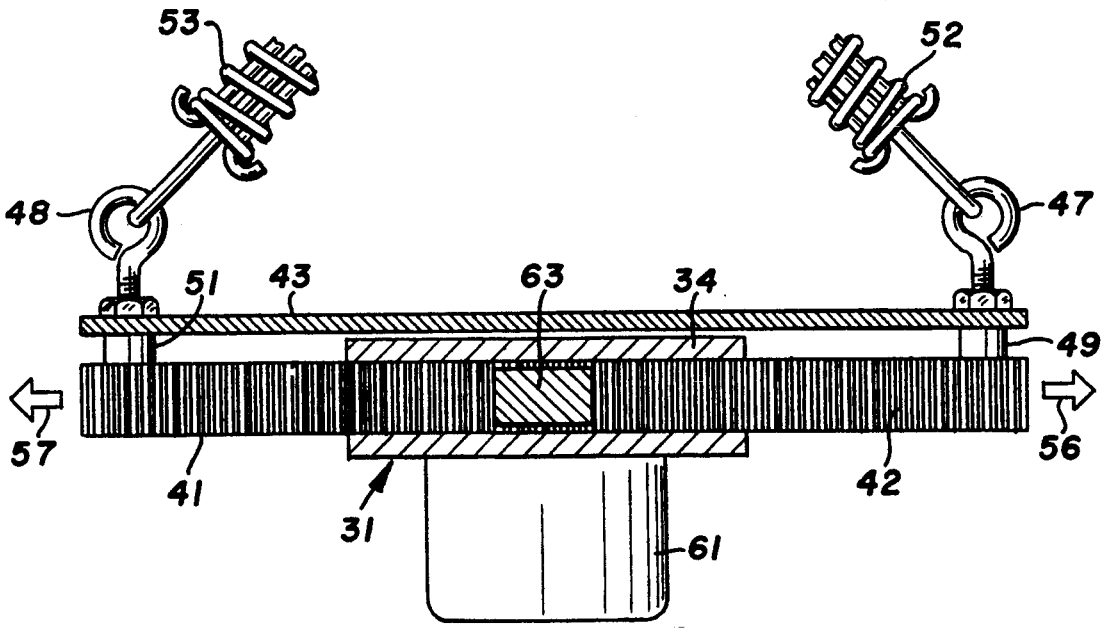
FIG. 6 is a sectional view taken along the line 6—6 of FIG. 3.
Figure 7:
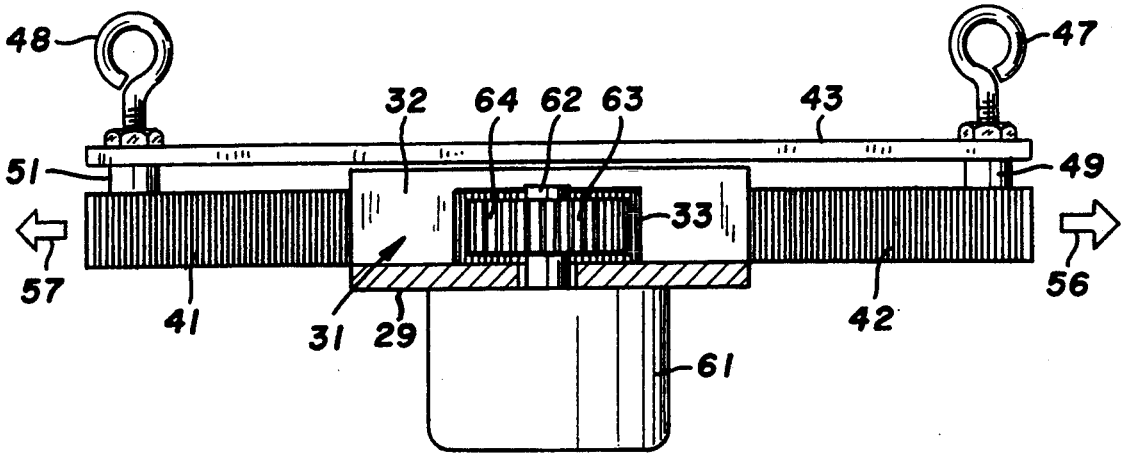
FIG. 7 is a sectional view taken along the line 7—7 of FIG. 3.

Referring to FIGS. 3 to 7, the outer end of angle mounting bracket 27 has a generally straight or transverse tubular member 31 incasing a linear gear rack 41. Tubular member 31 is located forwardly and below outboard motor 12 generally parallel to transom 11. Tubular member 31 has open ends and a generally rectangular cross section. Tubular member 31 has an inner side wall 32 including a centrally located opening 33 enabling drive gear 63 of a reversible electric gear head motor 61 to mesh with teeth 42 of rack 41, as seen in FIG. 7. Other structure can be utilized to mount tubular member 31 and gear rack 41 on boat 10.

Figure 4:
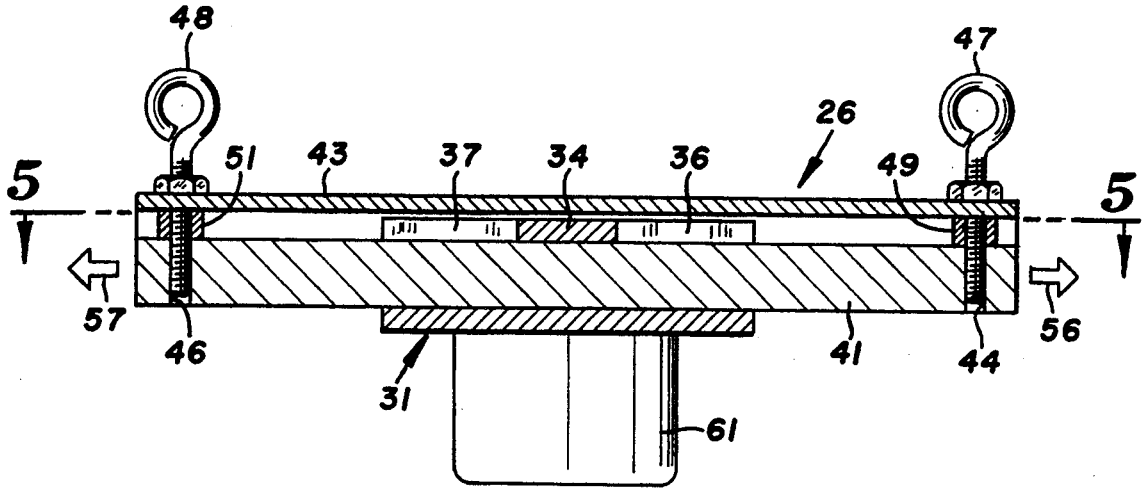
FIG. 4 is a sectional view taken along the line 4—4 of FIG. 3.

Tubular member 31 has a top wall 34 including a pair of longitudinally extending slots 36 and 37 opening at the opposite outer ends of tubular member 31. As shown in FIGS. 4 and 5, slots 36 and 37 are wide enough to receive the outer circumference of annular sleeves 49 and 51 accommodating eye bolts 47 and 48 as gear rack 41 is moved from side to side. Slots 36 and 37 allow eye bolts 47 and 48 and rack 41 to over travel angle bracket 27. Sleeves 49 and 51 engage tubular member 31 adjacent the inner end of slots 36 and 37 to stop lateral movement of rack 41.

Referring to FIGS. 2 and 5, gear rack 41 has a longitudinal length substantially longer than the length of tubular member 31. Gear rack 41 is rectangular shaped and slidingly disposed within tubular member 31. Gear rack 41 is provided with a plurality of gear teeth 42 on one side thereof which are aligned to mesh with teeth 64 of drive gear 63. An elongated rectangular-shaped cover or guard 43 having downwardly extending flanges is secured to rack 41 and extends over rack 41 and drive gear 63 to protect fisherperson 21 from getting entangled with the moving parts of steering mechanism 26. Guard 43 moves together with rack 41 when rack 41 is moved within tubular member 31. A second generally upright or rear guard 58 is secured to angle mounting bracket 27 with bolts 66 between drive gear 63 and the inner end of guard 43 to substantially enclose drive gear 63 and gear rack 41.

Referring to FIGS. 3 and 6, gear rack 41 has generally vertical threaded holes 44 and 46 located at its opposite ends accommodating hook or eye bolts 47 and 48. Each eye bolt 47, 48 extends upwardly from rack 41 through an annular sleeve 49, 51 and through guard 43. Sleeves 49 and 51 function to longitudinally space rack 41 from guard 43 whereby guard 43 moves above top wall 34 of tubular member 31 while rack 41 slides within tubular member 31. Sleeves 49 and 51 are moved into slots 36 and 37 in top wall 34 when rack 41 is laterally moved with electric motor 61. Sleeves 49 and 51 engage tubular member 31 adjacent the inner ends of slots 36 and 37 to limit lateral movement of gear rack 41 and guard 43.

Eye bolts 47 and 48 secured to gear rack 41 are coupled to outboard motor 12 with spring connectors 52 and 53. The opposite ends of spring connectors 52 and 53 converge upwardly and rearwardly and are attachable to a third hook or eye bolt 54 centrally located on a forward portion of bracket 17 secured to the bottom of power head 13 and drive tube 14. Springs 52 and 53 bias outboard motor 12 to turn toward the direction of lateral movement of gear rack 41 to steer boat 10 as desired. Lateral movement of gear rack 41 in the direction of arrow 54, shown in FIGS. 4 to 7, causes spring connector 52 to pull outboard motor in the same direction thereby pivoting bracket relative to transom 11, causing the propeller assembly to rotate to turn boat 10 in one direction. Lateral movement of rack 41 in the opposite direction, shown by arrow 57 in FIGS. 4 to 7, causes spring connector 53 to pull outboard motor 12 toward the direction of arrow 57, causing boat 10 to turn in an opposite direction. Connector springs 52 and 53 can be disconnected from eye bolt 54 to allow manual steering of outboard motor 12 with handle, if desired.

A small electric motor 61 is mounted on the outer portion of base plate 29 adjacent tubular member 31. Electric motor 61 has a drive shaft 62 which carries a worm or drive gear 63 fixed thereto, shaft 62 being rotatably mounted in suitable bearings in electric motor 61. Drive gear 63 has teeth 64 located in mesh with teeth 42 of rack 41.

Electric motor 61 is of the type that changes direction of rotation of drive shaft 62 when the electrical polarity at its terminals is reversed. As an example of an electric motor which may used herewith is of the type used to power electrically operated windows of an automobile. Bolts 66 threaded through rear guard 58 and base plate 29 are used to bolt electric motor 61 securely to base plate 29 with drive gear 63 in driving engagement with teeth 42 of rack 41. Drive shaft 62 carrying drive gear 63 projects upwardly through an opening 38 in base plate 29 in position to mesh with gear teeth 42 of rack 41. Drive shaft 62 rotates drive gear 63 located on the upper end of shaft 62.

Electric motor 61 is preferably a standard 12-volt direct current permanent magnet gear head motor. Electric motor 61 has a permanent magnet (not shown) for its field so that electric motor 61 can be operated in clockwise or counterclockwise direction by the reversal of the current running through electric motor 61. Upon actuation of electric motor 61, drive shaft 62 will be rotated driving gear 63 and effecting longitudinal sliding movement of gear rack 41 along tubular member 31. When electric motor 61 rotates in one direction this causes rack 41 in mesh with drive gear 63 to move linearly, moving with it bracket 17 of outboard motor 12 in the same direction. The propeller is thus also rotated causing boat 10 to turn in one direction. When electric motor 61 rotates in the opposite direction, drive gear 63 is rotated to linearly move gear rack 41 and bracket 17 of outboard motor 12 in the opposite direction, causing boat 10 to turn in the opposite direction. Electric motor 61 is independently powered with respect to outboard motor 12. Electric motor 61 and its drive gear 63 are self locking so as to hold whatever steering position is set thereby. In this manner, the entire power head 13, drive tube 14 and prop assembly is pivoted about the upstanding axis of outboard motor 12. Other types of motors can be used to rotate drive gear 63 to laterally move rack 41 relative to tubular member 31.

Electrical power for the operation of electric motor 61 is furnished from a battery 67. When electric motor 61 is energized with battery 67, it drives gear 63 to move rack 41 in a lateral direction thereby pulling the outboard motor 12 along with it to control the navigation of boat 10.

Returning to FIG. 1, a foot pedal control assembly 72 electrically connected to a battery 67 with lines 68 and 69 is used to operate electric gear head motor 61. Line 71 connects control assembly 72 to electric motor 61. Control assembly 72 may be laid in the bottom of boat 10 and moved to the switch positions by the foot of fisherperson 21. An example of a foot pedal control assembly useable to control the operation of electric steering gear head motor 61 is disclosed by H. W. Moser in U.S. Pat. No. 2,804,838. The direction of rotation of electric motor 61 is controlled by switches (not shown) which are operated by an independent left and right foot pedals 73 and 74. Left and right foot pedals 73 and 74 are arranged to reverse the flow of current through electric motor 61 and reverse the electrical polarity of motor 61 to produce rotation of drive gear 63 in the opposite direction for causing gear rack 41 to linearly move in a corresponding direction. This pulls outboard motor 12 in like manner thereby directing boat 10 in an different direction. When rack 41 is moved, the corresponding spring connector 52, 53 pulls on outboard motor 12 whereby the prop assembly of outboard motor 12 is caused to rotate in the desired direction to steer boat 10. Lever means (not shown) prevents both left and right foot pedals 73 and 74 from being depressed at the same time. Foot pedals 73 and 74 are mounted in a base 75 which also supports a third or center foot pedal 76 which the fisherperson 21 may press to kill or stop outboard motor 12. This arrangement allows steering and stopping of outboard motor 12 to be accomplished with one foot from a remote location on boat 10. Other types of control assemblies which may be operated by hand or by foot can be used to enable control of the direction of rotation of electric gear head motor 61 in either a clockwise or counterclockwise direction as desired.

In use, steering mechanism 26 is operably mounted on boat 10 equipped with an outboard motor 12. Steering mechanism 26 is quickly mounted on boat 10 by loosening outboard motor clamp screws 19 to allow upright end 28 of angle mounting bracket 27 to be inserted between the inside surface of boat transom 11 and the ends of clamp screws 19 which are then tightened down to clamp end 28 as well as mounting frame 18 of outboard motor 12 to transom 11. Electrical connections are made to connect electric motor 61 to battery 67 and to control assembly 72 having remote stop and steering control pedals 73, 74 and 76. When it is time to troll, spring connectors 52 and 53 can be connected in seconds to eye bolt 54 connected to bracket 17 of outboard motor 12. Left pedal 73 is arranged to cause electric motor 61 to rotate drive gear 63 clockwise and linearly move rack 41 to the right to pivot outboard motor 12 clockwise thereby steering boat 10 to the left or port. When right pedal 74 is depressed, electric motor 61 rotates drive gear 63 counterclockwise to linearly move rack 41 to the left causing outboard motor 12 to pivot counterclockwise to steer boat 10 to the right or starboard. Operator 21 may depress center pedal 76 to kill or stop outboard motor 12.

Assembly and attachment of steering mechanism 26 to outboard motor 12 and boat 10 is very simple, requiring only a few simple tools and not requiring that any holes to be drilled, parts welded or the like. Steering mechanism 26 is essentially universal and useable for controlling the steering of pivotally mounted outboard motors on any type of marine craft.

While there has been shown and described a preferred embodiment of the steering apparatus, it is understood that changes in materials, structure and arrangement of structure can be made by those skilled in the art without departing from the invention. The invention is defined in the following claims.

I claim:

1. A steering apparatus for remote control of an outboard motor pivotally mounted on the stern of a boat With clamping means, comprising: bracket means having a first end and a second end, the first end mounted to the stem of the boat with the clamping means mounting the outboard motor to the boat, the second end including tubular means, rack means slidably accommodated by the tubular means, the tubular means including a top wall having a pair of transverse slots open to opposite ends thereof, connector means secured to the rack means and attachable to the outboard motor, the connector means being aligned with and movable into the slots and operable to pull the outboard motor from side to side when the rack means is linearly moved relative to the tubular means to control the direction of movement of the boat, motor means secured to the bracket means, the motor means operable to reversibly move the rack means in opposite lateral directions, and control means operably connected to a source of power and to the motor means to control the operation of the motor means to linearly move the rack means thereby steering the boat from a location remote from a rear area of the boat.

2. The apparatus of claim 1 wherein: the tubular means includes a side wall having a centrally located opening therein.

3. The apparatus of claim 1 wherein: the tubular means comprises a generally tubular member extending linearly generally parallel to the stern of the boat.

4. The apparatus of claim 1 wherein: the rack means is an elongated generally rectangular member slidably located within the tubular means, the rectangular member having a side wall having a plurality of teeth located in engagement with the motor means.

5. The apparatus of claim 1 including: a guard secured to the rack means covering a top portion of the rack means and the motor means.

6. The apparatus of claim 1 wherein: the connectors means are connected to opposite ends of the rack means and to the outboard motor.

7. A steering apparatus for an outboard motor pivotally mounted on the stern of a boat with clamping means, comprising: bracket means having a first end and a second end, the first end mounted to the stern of the boat with the clamping means mounting the outboard motor to the boat, the second end including guide means, rack means slidably accommodated by the guide means, the guide means accommodating the rack means including a top wall having a pair of transverse slots open to opposite ends thereof, connector means secured to the rack means and attachable to the outboard motor, the connector means being aligned with and movable into the slots and operable to pull the outboard motor from side to side when the rack means is linearly moved relative to the guide means accommodating the rack means to control the direction of movement of the boat, and motor means secured to the bracket means, the motor means operable to reversibly move the rack means in opposite lateral directions thereby steering the boat as desired.

8. The apparatus of claim 7 wherein: the guide means accommodating the rack means includes a side wall having a centrally located opening therein.

9. The apparatus of claim 7 wherein: the guide means accommodating the rack means comprises a generally tubular member extending linearly generally parallel to the stern of the boat.

10. The apparatus of claim 7 wherein: the rack means is an elongated generally rectangular member slidably located within the guide means accommodating the rack means, the rectangular member having a side wall having a plurality of teeth located in engagement with the motor means.

11. The apparatus of claim 7 including: a guard secured to the rack means covering a top portion of the rack means and the motor means.

12. The apparatus of claim 7 wherein: the connectors means are connected to opposite ends of the rack means and to the outboard motor.

13. A steering apparatus for an outboard motor pivotally mounted on the stem of a boat with clamping means, comprising: first means having a first end and a second end, the first end mounted to the stem of the boat with the clamping means mounting the outboard motor to the boat, a generally linear gear rack accommodated by the second end of the first means, the second end including a wall having a pair of transverse slots open to opposite ends thereof, connector means secured to the rack and attachable to the outboard motor, the connector means being aligned with and movable into the slots and operable to pull the outboard motor from side to side when the rack is linearly moved relative to the second end to control the direction of movement of the boat, second means secured to the first means operable to reversibly move the rack in opposite lateral directions, and third means operably connected to a source of power and to the second means to control the operation of the second means to linearly move the rack thereby steering the boat from a location remote from a rear area of the boat.

14. The apparatus of claim 13 wherein: the second end includes a side wall having a centrally located opening therein.

15. The apparatus of claim 13 wherein: the second end comprises a generally tubular member extending linearly generally parallel to the stern of the boat.

16. The apparatus of claim 13 wherein: the rack is an elongated generally rectangular member slidably located on the second end, the rectangular member having a side wall having a plurality of teeth located in engagement with the second means.

17. The apparatus of claim 13 including: a guard secured to the rack covering a top portion of the rack and the second means.

18. The apparatus of claim 13 wherein: the connector means are connected to opposite ends of the rack means and to the outboard motor.

19. A steering apparatus for an outboard motor including clamping means for mounting the motor on a boat comprising: a mounting bracket having a first generally upright end joined to a second generally transverse end, the first end secured to an upright wall of the boat with the clamping means mounting the outboard motor to the upright wall whereby the second extends forwardly and below the outboard motor, the second end including guide means, rack means slidably accommodated by the guide means, connector means connected to the rack means and the outboard motor whereby when the rack means is linearly moved relative to the means accommodating the rack means the outboard motor is rotated, the connector means comprising a first spring member extending between a first end of the rack means and the outboard motor to bias the outboard motor to turn toward in one direction, and a second spring member extending between a second end of the rack means and the outboard motor to bias the outboard motor to turn toward an opposite direction, and means secured to the bracket operable to linearly move the rack means.

20. The apparatus of claim 19 wherein: the first and second spring members converge upwardly and rearwardly to a forward portion of the outboard motor.

21. The apparatus of claim 19 wherein: the first and second spring members are removably connected to the outboard motor.

22. The apparatus of claim 19 wherein: the upright end of the bracket is removable from the boat by loosening the clamping means mounting the outboard motor to the upright wall of the boat.

23. The apparatus of claim 19 wherein: the guide means includes a wall having a pair of transverse slots open to opposite ends thereof, the connector means being aligned with and movable into the slots when the rack means is linearly moved relative to the guide means.

* * * * *